US009842543B2

(12) United States Patent
Zhou

(10) Patent No.: US 9,842,543 B2
(45) Date of Patent: Dec. 12, 2017

(54) OLED PIXEL COMPENSATION CIRCUIT

(71) Applicant: EverDisplay Optronics (Shanghai) Limited, Shanghai (CN)

(72) Inventor: Xingyu Zhou, Shanghai (CN)

(73) Assignee: EverDisplay Optronics (Shanghai) Limited, Shanghai (CN)

( * ) Notice: Subject to any disclaimer, the term of this patent is extended or adjusted under 35 U.S.C. 154(b) by 73 days.

(21) Appl. No.: 15/096,968

(22) Filed: Apr. 12, 2016

(65) Prior Publication Data

US 2016/0314742 A1 Oct. 27, 2016

(30) Foreign Application Priority Data

Apr. 23, 2015 (CN) ..... 2015 1 0196722

(51) Int. Cl.
*G09G 3/3258* (2016.01)

(52) U.S. Cl.
CPC ... *G09G 3/3258* (2013.01); *G09G 2300/0814* (2013.01); *G09G 2300/0819* (2013.01); *G09G 2300/0842* (2013.01); *G09G 2300/0861* (2013.01); *G09G 2310/0251* (2013.01); *G09G 2310/0262* (2013.01); *G09G 2310/08* (2013.01); *G09G 2320/0233* (2013.01); *G09G 2320/0238* (2013.01); *G09G 2320/043* (2013.01); *G09G 2320/045* (2013.01)

(58) Field of Classification Search
CPC ... G09G 2300/0814; G09G 2300/0819; G09G 2300/0842; G09G 2300/0861; G09G 2310/0251; G09G 2310/0262; G09G 2310/08; G09G 2320/0233; G09G 2320/0238; G09G 2320/043; G09G 2320/045; G09G 3/3258
USPC ..... 345/76, 212
See application file for complete search history.

(56) References Cited

U.S. PATENT DOCUMENTS 9,489,888 B2 * 11/2016 Kim ..... G09G 3/3233
2009/0167648 A1 * 7/2009 Jeon ..... G09G 3/3233 345/76
2015/0002502 A1 * 1/2015 Kim ..... G09G 3/3233 345/212

* cited by examiner

*Primary Examiner* — Tony Davis
(74) *Attorney, Agent, or Firm* — Wang Law Firm, Inc.

(57) ABSTRACT

An organic light-emitting diode (OLED) pixel compensation circuit includes a driving module, a compensation module, an OLED lighting module, and a precharging module. The compensation module is connected to the driving module and is configured to receive a voltage of an external first power for compensating a turn-on voltage of the driving module. The precharging module is connected to the OLED lighting module and is configured to receive a voltage of an external second power for precharging the OLED lighting module. The driving module is connected to the OLED lighting module and is configured to remain on under compensation by the compensation module for receiving the voltage of the external first power to obtain a driving voltage for driving the OLED lighting module to emit light, thereby driving the OLED lighting module to emit light.

17 Claims, 12 Drawing Sheets

OLED PIXEL COMPENSATION CIRCUIT

CROSS-REFERENCE TO RELATED INVENTIONS

The present invention claims priority to and the benefit of Chinese Patent invention No. CN 201510196722.3, filed on Apr. 23, 2015, the entire content of which is incorporated herein by reference.

BACKGROUND OF THE INVENTION

The present invention relates to a circuit and, more particularly, to an organic light-emitting diode (OLED) pixel compensation diode.

Organic light-emitting diodes are essential new element for flat panel display devices and have wide applications due to the advantages of self-illumination, high contrast ratio, wide color gamut as well as simple production technology, low cost, low power consumption, and ease of fulfilling flexible display.

Despite the above advantages, OLED display devices incur many problems during applications. For example, in a thin film transistor (TFT) using an OLED as a switch or a driving element, the stability of the gate voltage is critical, particularly in the black state. If the gate voltage is unstable, the brightness of the black state is affected and results in a reduction in the contrast ratio and an increase in the value of the storage capacitor. Thus, the space occupied by the storage capacitor is increased, the output space is reduced, and the pixels per inch (PPI) of the OLED display device is reduced, reducing the performance of the product.

FIG. 1 shows a diagrammatic circuit diagram of a conventional OLED pixel compensation circuit, in which T2 is a driving transistor for driving the OLED to emit light, Cst is a storage capacitor, Dm is a data signal line, En is a control signal line, Sn, Sn−1, and Sn' are scan signal lines, ELVDD is a power providing the driving transistor T2 with a voltage for driving the OLED to emit light, ELVSS is a cathode voltage, and Vin is an initialization power providing an initialization voltage to the OLED and the gate (node N9) of the driving transistor T2, with the voltage of Vin being smaller than the voltage of the ELVDD and the data voltage. The electrical leakage of the dual gate structures T5 and T6 of the circuit flows from the gate (node N9) of the driving transistor T2 to a voltage node with a more negative voltage. Specifically, the electrical leakage of the T5 dual gate structure flows from the gate (N9 node) of the driving transistor T2 to the ELVSS (as indicated by arrow a), and the electrical leakage of the T6 dual gate structure flows from the gate (N9 node) of the driving transistor T2 to the Vin (as indicated by arrow b). Thus, the gate voltage of the driving transistor T2 will become unstable due to a voltage change resulting from electrical leakage of the T5 and T6 dual gate structures, adversely affecting the performance of the OLED display device.

BRIEF SUMMARY OF THE INVENTION

In view of the above problems, the present invention provides an organic light-emitting diode (OLED) pixel compensation circuit including a driving module, a compensation module, an OLED lighting module, and a precharging module. The compensation module is connected to the driving module and is configured to receive a voltage of an external first power for compensating a turn-on voltage of the driving module. The precharging module is connected to the OLED lighting module and is configured to receive a voltage of an external second power for precharging the OLED lighting module. The driving module is connected to the OLED lighting module and is configured to remain on under compensation by the compensation module for receiving the voltage of the external first power to obtain a driving voltage for driving the OLED lighting module to emit light, thereby driving the OLED lighting module to emit light.

The OLED pixel compensation circuit uses the compensation module to compensate the turn-on voltage of the driving module, such that the turn-on voltage of the driving module is in a stable state to avoid adverse effect on the brightness of the OLED lighting module, providing the OLED display device with more uniform brightness. Furthermore, the service life of the OLED display device can be prolonged by precharging the OLED lighting module through the precharging module.

Each of the driving module, the compensation module, and the precharging module can include a first terminal, a second terminal, and a control terminal. The first terminal of the driving module is connected to the first power. The second terminal of the driving module is connected to an anode of the OLED lighting module. The control terminal of the driving module is connected to the second terminal of the compensation module. The first terminal of the compensation module is connected to the first power, the control terminal of the compensation module is connected to and controlled by an external first scan signal line. The first terminal of the precharging module is connected to the second power Vin. The second terminal of the precharging module is connected to the anode of the OLED lighting module. The control terminal of the precharging module is connected to and controlled by an external second scan line. The OLED lighting module includes a cathode, with the cathode receiving a voltage of a third power.

The second scan signal line can be n−1th scan signal line, and the first scan signal line can be the nth scan signal line.

The organic light-emitting diode pixel compensation circuit can further include an initialization module. The initialization module includes a first terminal, a second terminal, and a control terminal. The first terminal of the initialization module is connected to the control terminal of the driving module. The second terminal of the initialization module is connected to the second power source, is configured to receive the voltage of the second power, and is configured to clear the voltage currently stored by the control terminal of the driving module. The control terminal of the initialization module is connected to and controlled by the second scan line.

The organic light-emitting diode pixel compensation circuit can further include a data selection module. The data selection module includes a first terminal, a second terminal, and a control terminal. The first terminal of the data selection module is connected to the second terminal of the driving module. The second terminal of the data selection module is connected to an external data signal line, is configured for receiving a data signal of the data signal line, and is configured for inputting the data signal to control terminal of the driving module. The control terminal of the data selection module is connected to and controlled by the first scan line.

The organic light-emitting diode pixel compensation circuit can further include a voltage storage module. The voltage storage module includes a first terminal and a second terminal. The first terminal of the voltage storage module is connected to the first power. The second terminal of the voltage storage module is connected to the control terminal of the driving module and is configured to store the voltage received by the control terminal of the driving module.

The organic light-emitting diode pixel compensation circuit can further include a first switch module. The first switch module includes a first terminal, a second terminal, and a control terminal. The first terminal of the first switch module is connected to the first power. The second terminal of the first switch module is connected to the first terminal of the driving module and the first terminal of the compensation module and is configured to control ON and OFF statesOFF state of a circuit between the first power and the driving module and ON and OFF statesON and OFF states states of a circuit between the first power and the compensation module. The control terminal of the first switch module is connected to and controlled by an external control signal line.

The organic light-emitting diode pixel compensation circuit can further include a second switch module. The second switch module includes a first terminal, a second terminal, and a control terminal. The first terminal of the second switch module is connected to the second terminal of the driving module. The second terminal of the second switch module is connected to the anode of the OLED lighting module and is configured to control ON and OFF states of a circuit between the driving module and the OLED lighting module. The control terminal of the second switch module is connected to and controlled by the control signal line.

The driving module can include a driving transistor. The driving transistor includes a first electrode serving as the first terminal of the driving module. The driving transistor further includes a second electrode serving as the second terminal of the driving module. The driving transistor further includes a gate serving as the control terminal of the driving module.

The compensation module can include a second transistor. The second transistor includes a first electrode serving as the first terminal of the compensation module. The second transistor further includes a second electrode serving as the second terminal of the compensation module. The second transistor further includes a gate serving as the control terminal of the compensation module.

The precharging module can include a third transistor. The third transistor includes a first electrode serving as the first terminal of the precharging module. The third transistor further includes a second electrode serving as the second terminal of the precharging module. The third transistor further includes a gate serving as the control terminal of the precharging module.

The first switch module can include a sixth transistor. The sixth transistor includes a first electrode serving as the first terminal of the first switch module. The sixth transistor further includes a second electrode serving as the second terminal of the first switch module. The sixth transistor further includes a gate serving as the control terminal of the first switch module.

The second switch module can include a seventh transistor. The seventh transistor includes a first electrode serving as the first terminal of the second switch module. The seventh transistor further includes a second electrode serving as the second terminal of the second switch module. The seventh transistor further includes a gate serving as the control terminal of the second switch module.

The data selection module can include an eighth transistor. The eighth transistor includes a first electrode serving as the first terminal of the data selection module. The eighth transistor further includes a second electrode serving as the second terminal of the data selection module. The eighth transistor further includes a gate serving as the control terminal of the data selection module.

The voltage storage module can be a storage capacitor. The storage capacitor includes a first terminal connected to the first power and a second terminal connected to the gate of the driving transistor.

In a first example, the initialization module includes a dual gate structure having a fourth transistor and a fifth transistor. The fourth transistor includes a first electrode serving as the first terminal of the initialization module. The fourth transistor further includes a second electrode connected to a first electrode of the fifth transistor. A gate of the fourth transistor and a gate of the fifth transistor are connected to the same node serving as the control terminal of the initialization module. The fifth transistor further includes a second electrode serving as the second terminal of the initialization module.

Each of the driving transistor, the second transistor, the third transistor, the fourth transistor, the fifth transistor, the sixth transistor, the seventh transistor, and the eighth transistor can be a p-channel thin film transistor.

In a second example, the initialization module includes a ninth transistor. The ninth transistor includes a first electrode serving as the first terminal of the initialization module. The ninth transistor further includes a second electrode serving as the second terminal of the initialization module. The ninth transistor further includes a gate serving as the control terminal of the initialization module.

Each of the driving transistor, the second transistor, the third transistor, the sixth transistor, the seventh transistor, the eighth transistor, and the ninth transistor can be a p-channel thin film transistor.

Each of the first power, the second power, and the data signal line can be a direct current power. The data signal of the data signal line is larger than the voltage of the second power. The voltage of the first power is larger than a voltage difference between the data signal of the data signal line and a threshold voltage of the driving transistor.

In the OLED pixel compensation circuit according to the present invention, since electrical leakage occurs in the fourth and fifth transistors or the ninth transistor of the initialization module in the off state, the gate voltage of the driving transistor is reduced. The gate voltage of the driving transistor is compensated by the second transistor to assure the stability of the gate voltage of the driving transistor. This reduces the influence on the gate voltage of the driving transistor by the transistors in the off state in the circuit due to leak current, thereby reducing the influence on the image display quality by the transistors due to electrical leakage. Furthermore, the stability of the gate voltage of the driving transistor is assured while reducing the value of the storage capacitor. Thus, the space occupied by the storage capacitor is reduced to increase the output space, such that the pixels per inch (PPI) of the OLED display device are increased.

It is to be noted that the advantages of the embodiments presented in this disclosure include the following:

- the compensation module is connected to the driving module and is configured to receive a voltage supplied from an external first power to compensate a turn-on voltage of the driving module,
- the precharging module is connected to the OLED module and is configured to receive a voltage supplied from an external second power to precharge the OLED module, and
- the driving module is connected to the OLED module and is configured to remain ON state by compensation effection of the compensation module, such that the voltage supplied from the external first power is able to be received by the driving module and transferred to drive the OLED module.

A further objective of the disclosure includes that each of the driving module, the compensation module, and the precharging module includes a first terminal, a second terminal, and a control terminal, the first terminal of the driving module is connected to the first power, the second terminal of the driving module is connected to an anode of the OLED module, the control terminal of the driving module is connected to the second terminal of the compensation module, the first terminal of the compensation module is connected to the first power, the control terminal of the compensation module is connected to and controlled by an external first scan signal line, the first terminal of the precharging module is connected to the second power Vin, the second terminal of the precharging module is connected to the anode of the OLED module, the control terminal of the precharging module is connected to and controlled by an external second scan line, and the OLED module includes a cathode configured to receive a voltage supplied from a third power.

A further objective of the disclosure includes that the external second scan line is an N−1th scan signal line, and the external first scan line is an Nth scan signal line.

Still a further objective of the disclosure includes that an initialization module, wherein the initialization module comprises a first terminal connected to the control terminal of the driving module, a second terminal connected to the second power source and configured to receive the voltage of the second power and to clear the voltage currently stored by the control terminal of the driving module, and a control terminal connected to and controlled by the second scan line.

Still a further objective of the disclosure includes that a data selection module, wherein the data selection module comprises a first terminal connected to the second terminal of the driving module, a second terminal connected to an external data signal line and configured to receive a data signal of the data signal line and to input the data signal to the control terminal of the driving module, and a control terminal connected to and controlled by the first scan line.

Still a further objective of the disclosure includes a voltage storage module, wherein the voltage storage module comprises a first terminal and a second terminal, the first terminal of the voltage storage module is connected to the first power, and the second terminal of the voltage storage module is connected to the control terminal of the driving module and configured to store the voltage received by the control terminal of the driving module.

Still a further objective of the disclosure includes a first switch module, wherein the first switch module including a first terminal connected to the first power, a second terminal connected to the first terminal of the driving module and the first terminal of the compensation module and configured to control ON and OFF states states of circuits individually between the first power and the driving module and between the first power and the compensation module, and a control terminal connected to and controlled by an external control signal line.

Still a further objective of the disclosure includes a second switch module, wherein the second switch module comprises a first terminal connected to the second terminal of the driving module, a second terminal connected to the anode of the OLED module and configured to control ON and OFF states states of a circuit between the driving module and the OLED module, and a control terminal connected to and controlled by the control signal line.

Still a further objective of the disclosure includes the driving module comprises a driving transistor, the driving transistor includes a first electrode serving as the first terminal of the driving module, with the driving transistor further including a second electrode serving as the second terminal of the driving module, and with the driving transistor further including a gate serving as the control terminal of the driving module.

Still a further objective of the disclosure includes that each of the driving transistor, the second transistor, the third transistor, the fourth transistor, the fifth transistor, the sixth transistor, the seventh transistor, and the eighth transistor is a p-channel thin film transistor.

Still a further objective of the disclosure includes each of the driving transistor, the second transistor, the third transistor, the sixth transistor, the seventh transistor, the eighth transistor, and the ninth transistor is a p-channel thin film transistor.

Still a further objective of the disclosure includes each of the first power, the second power, and the data signal line is a direct current power supplier, and the data signal provided from the data signal line is larger than the voltage provided from the second power, and the voltage provided from the first power is larger than a voltage difference between the data signal of the data signal line and a threshold voltage of the driving transistor.

The present invention will become clearer in light of the following detailed description of illustrative embodiments of this invention described in connection with the drawings.

DETAILED DESCRIPTION OF THE INVENTION

Figure 2:
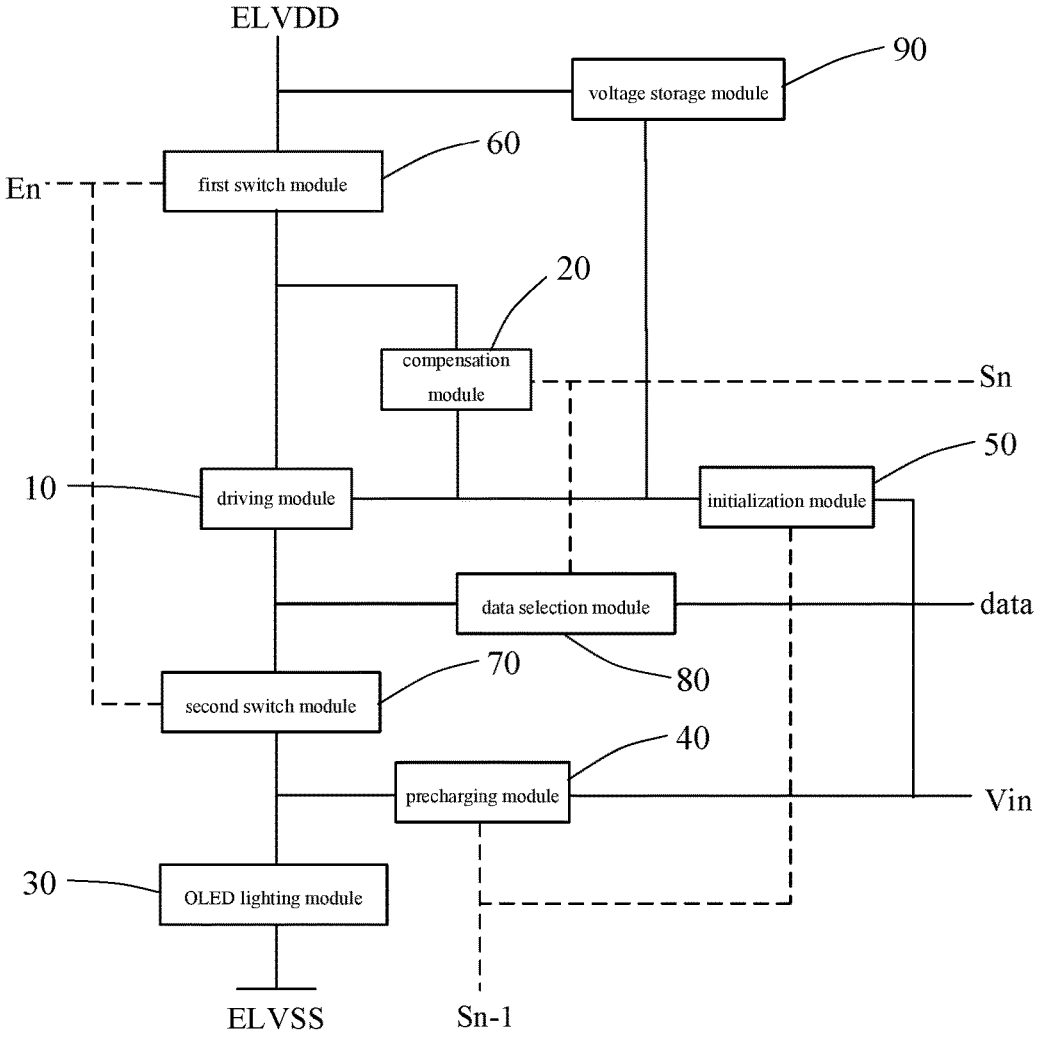
FIG. 2 is a diagrammatic structural view of an OLED pixel compensation circuit according to the present invention.

FIG. 2 is a diagrammatic structural view of an organic light-emitting diode (OLED) pixel compensation circuit according to the present invention. The OLED pixel compensation circuit according to the present invention includes a driving module 10, a compensation module 20, an organic light-emitting diode (OLED) lighting module 30, a precharging module 40, an initialization module 50, a first switch module 60, a second switch module 70, a data selection module 80, and a voltage storage module 90. Aside from the OLED lighting module 30 and the voltage storage module 90, each of the remaining modules includes a first terminal, a second terminal, and a control terminal. The OLED lighting module 30 includes an anode and a cathode. The voltage storage module 90 includes a first terminal and a second terminal. The connections of the modules of the OLED pixel compensation device will now be set forth.

The first terminal of the driving module 10 is connected to the second terminal of the first switch module 60. The second terminal of the driving module 10 is connected to the first terminal of the second switch module 70. The control terminal of the driving module 10 is connected to the second terminal of the compensation module 20, the first terminal of the initialization module 50, and the second terminal of the voltage storage module 90.

The first terminal of the compensation module 20 is connected to the second terminal of the first switch module 60. The second terminal of the compensation module 20 is connected to the control terminal of the driving module 10. The control terminal of the compensation module 20 is connected to and controlled by an external first scan signal line Sn.

The anode of the OLED lighting module 30 is connected to the second terminal of the second switch module 70 and the second terminal of the precharging module 40. The cathode of the OLED lighting module 30 receives the voltage of a third power ELVSS.

The first terminal of the precharging module 40 is connected to an external second power Vin. The second terminal of the precharging module 40 is connected to the anode of the OLED lighting module 30. The control terminal of the precharging module 40 is connected to and controlled by an external second scan signal line Sn−1.

The first terminal of the initialization module 50 is connected to the control terminal of the driving module 10. The second terminal of the initialization module 50 is connected to the second power Vin. The control terminal of the initialization module 50 is connected to and controlled by the second scan signal line Sn−1.

The first terminal of the first switch module 60 is connected to the first power ELVDD. The second terminal of the first switch module 60 is connected to the first terminal of the driving module 10 and the first terminal of the compensation module 20. The control terminal of the first switch module 60 is connected to and controlled by an external control signal line En.

The first terminal of the second switch module 70 is connected to the second terminal of the driving module 10. The second terminal of the second switch module 70 is connected to the anode of the OLED lighting module 30. The control terminal of the second switch module 70 is connected to and controlled by the control signal line En.

The first terminal of the data selection module 80 is connected to the second terminal of the driving module 10. The second terminal of the data selection module 80 is connected to an external data signal line data. The control terminal of the data selection module 80 is connected to and controlled by the first scan signal line Sn.

The first terminal of the voltage storage module 90 is connected to the first power ELVDD. The second terminal of the voltage storage module 90 is connected to the control terminal of the driving module 10.

Preferably, the second scan signal line Sn−1 is the n−1th scan signal line, and the first scan signal line Sn is the nth scan signal line.

The functions of the modules of the OLED pixel compensation circuit according to the present invention will now be set forth.

The compensation module 20 is configured to receive the voltage of the first power ELVDD for compensating the turn-on voltage of the driving module 10.

The driving module 10 is configured to remain on under compensation by the compensation module 20 for receiving the voltage of the external first power ELVDD to obtain a driving voltage for driving the OLED lighting module 30 to emit light, thereby driving the OLED lighting module 30 to emit light.

The precharging module 40 is configured to receive the voltage of the second power Vin for precharging the OLED lighting module 30.

The initialization module 50 is configured to receive the voltage of the second power Vin and is configured to clear the voltage currently stored by the control terminal of the driving module 10.

The first switch module 60 is configured to control ON and OFF states of a circuit between the first power ELVDD and the driving module 10 and ON and OFF states of a circuit between the first power ELVDD and the compensation module 20.

The second switch module 70 is configured to control ON and OFF states of a circuit between the driving module 10 and the OLED lighting module 30.

The data selection module 80 is configured for receiving a data signal of the data signal line data and is configured for inputting the data signal to the control terminal of the driving module 10.

The voltage storage module 90 is configured to store the voltage currently received by the control terminal of the driving module 10.

The driving method of the OLED pixel compensation circuit includes the following steps.

Under control of the second scan signal line Sn−1, the precharging module 40 inputs the voltage of the second power Vin to the anode of the OLED lighting module 30 to precharge the OLED lighting module 30.

Under control of the second scan signal line Sn−1, the initialization module 50 inputs the voltage of the second power Vin to the control terminal of the driving module 10 to clear the voltage currently stored by the control terminal of the driving module 10.

Under control of the first scan signal line Sn, the data selection module 80 inputs the data signal of the data signal line data to the control terminal of the driving module 10 to charge the voltage storage module 90 to thereby serve as the turn-on voltage of the driving module 10.

Under control of the first scan signal line Sn, the compensation module 20 inputs the data signal of the data signal line data to the control terminal of the driving module 10 to compensate the turn-on voltage of the driving module 10.

The first switch module 60 and the second switch module 70 are opened under control of the control signal line En. The driving module 10 receives the voltage of the first power ELVDD through the first switch module 60 to obtain the driving voltage for driving the OLED lighting module 30 to emit light. Then, the second switch module 70 inputs the driving voltage to the OLED lighting module 30 to thereby drive the OLED lighting module 30 to emit light.

The OLED pixel compensation circuit uses the compensation module 20 to compensate the turn-on voltage of the driving module 10, such that the turn-on voltage of the driving module 10 is in a stable state to avoid adverse effect on the brightness of the OLED lighting module 30, providing the OLED display device with more uniform brightness. Furthermore, the service life of the OLED display device can be prolonged by precharging the OLED lighting module 30 through the precharging module 40.

Two embodiments of the OLED pixel compensation circuit according to the present invention will now be set forth in connection with the accompanying drawings.

First Embodiment

Figure 3:
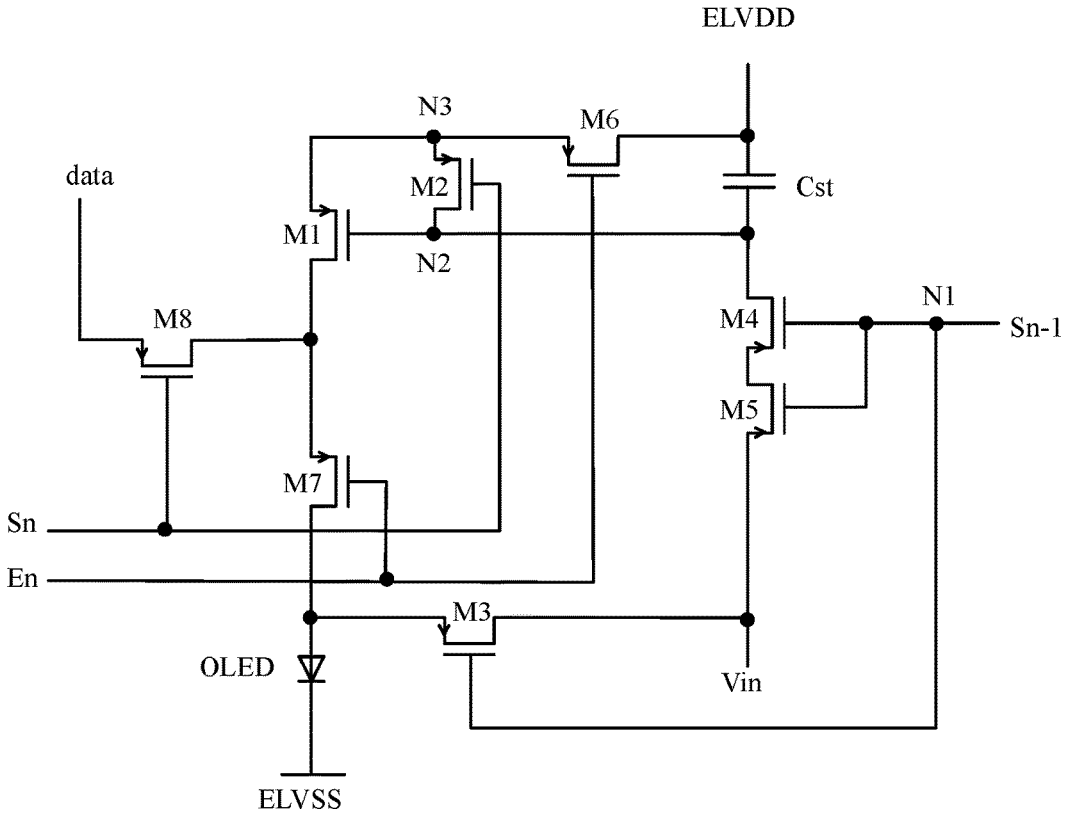
FIG. 3 is a circuit diagram of a first embodiment of the OLED pixel compensation circuit according to the present invention.

FIG. 3 is a circuit diagram of the first embodiment of the OLED pixel compensation circuit according to the present invention.

Specifically, the driving module 10 includes a driving transistor M1. The driving transistor M1 includes a first electrode connected to the second terminal of the first switch module 60. The driving transistor M1 further includes a second electrode connected to the first terminal of the second switch module 70. The driving transistor M1 further includes a gate connected to the second terminal of the compensation module 20, the first terminal of the initialization module 50, and the second terminal of the voltage storage module 90. The first electrode of the driving transistor M1 serves as the first terminal of the driving module 10. The second electrode of the driving transistor M1 serves as the second terminal of the driving module 10. The gate of the driving transistor M1 serves as the control terminal of the driving module 10.

The compensation module 20 includes a second transistor M2. The second transistor M2 includes a first electrode connected to the second terminal of the first switch module 60. The second transistor M2 further includes a second electrode connected to the gate of the driving transistor M1. The second transistor M2 further includes a gate connected to the first scan signal line Sn. The first electrode of the second transistor M2 serves as the first terminal of the compensation module 20. The second electrode of the second transistor M2 serves as the second terminal of the compensation module 20. The gate of the second transistor M2 serves as the control terminal of the compensation module 20.

The precharging module 40 includes a third transistor M3. The third transistor M3 includes a first electrode connected to the second power Vin. The third transistor M3 further includes a second electrode connected to the anode of the OLED lighting module 30. The third transistor M3 further includes a gate connected to the second scan signal line Sn−1. The first electrode of the third transistor M3 serves as the first terminal of the precharging module 40. The second electrode of the third transistor M3 serves as the second terminal of the precharging module 40. The gate of the third transistor M3 serves as the control terminal of the precharging module 40.

The initialization module 50 includes a dual gate structure having a fourth transistor M4 and a fifth transistor M5. The fourth transistor M4 includes a first electrode connected to the gate of the driving transistor M1. The fourth transistor M4 further includes a second electrode connected to a first electrode of the fifth transistor M5. A second electrode of the fifth transistor M5 is connected to the second power Vin. A gate of the fourth transistor M4 and a gate of the fifth transistor M5 are connected to the same node N1. The node N1 is connected to the second scan signal line Sn−1. The first electrode of the fourth transistor M4 serves as the first terminal of the initialization module 50. The second electrode of the fifth transistor M5 servers as the second terminal of the initialization module 50. The node N1 serves as the control terminal of the initialization module 50.

The first switch module 60 includes a sixth transistor M6. The sixth transistor M6 includes a first electrode connected to the first power ELVDD. The sixth transistor M6 further includes a second electrode connected to the first electrode of the driving transistor M1 and the first electrode of the second transistor M2. The sixth transistor M6 further includes a gate connected to the control signal line En. The first electrode of the sixth transistor M6 serves as the first terminal of the first switch module 60. The second electrode of the sixth transistor M6 serves as the second terminal of the first switch module 60. The gate of the sixth transistor M6 serves as the control terminal of the first switch module 60.

The second switch module 70 includes a seventh transistor M7. The seventh transistor M7 includes a first electrode connected to the second electrode of the driving transistor M1. The seventh transistor M7 further includes a second electrode connected to the anode of the OLED lighting module 30. The seventh gate M7 further includes a gate connected to the control signal line En. The first electrode of the seventh gate M7 serves as the first terminal of the second switch module 70. The second electrode of the seventh transistor M7 serves as the second terminal of the second switch module 70. The gate of the seventh transistor M7 serves as the control terminal of the second switch module 70.

The data selection module 80 includes an eighth transistor M8. The eighth transistor M8 includes a first electrode connected to the second electrode of the driving transistor M1. The eighth transistor M8 further includes a second electrode connected to the data signal line data. The eighth transistor M8 further includes a gate connected to the first scan signal line Sn. The first electrode of the eighth transistor M8 serves as the first terminal of the data selection module 80. The second electrode of the eighth transistor M8 serves as the second terminal of the data selection module 80. The gate of the eighth transistor M8 serves as the control terminal of the data selection module 80.

The voltage storage module 90 is a storage capacitor Cst. The storage capacitor Cst includes a first terminal connected to the first power ELVDD and a second terminal connected to the gate of the driving transistor M1.

The anode of the OLED lighting module 30 (i.e., the OLED) is connected to the second electrode of the third transistor M3 and the second electrode of the seventh transistor M7. The cathode of the OLED lighting module 30 receives the voltage of the third power ELVSS.

Furthermore, each of the driving transistor M1, the second transistor M2, the third transistor M3, the fourth transistor M4, the fifth transistor M5, the sixth transistor M6, the seventh transistor M7, and the eighth transistor M8 is a p-channel thin film transistor. Each of the first power ELVDD, the second power Vin, and the data signal line data is a direct current power. The data signal $V_{data}$ of the data signal line data is larger than the voltage $V_{Vin}$ of the second power Vin. When in the lighting state, the voltage $V_{ELVDD}$ of the first power ELVDD is larger than the voltage difference ($V_{data}-V_{th}$) between the data signal $V_{data}$ of the data signal line data and the threshold voltage $V_{th}$ of the driving transistor M1. When in a black screen state, the voltage $V_{ELVDD}$ of the first power ELVDD is smaller than the voltage difference ($V_{data}-V_{th}$) between the data signal $V_{data}$ of the data signal line data and the threshold voltage $V_{th}$ of the driving transistor M1.

Figure 4:
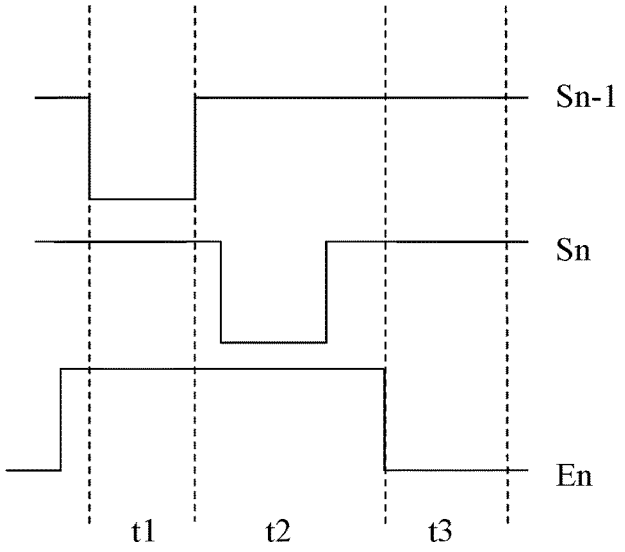
FIG. 4 is a timing diagram of the OLED pixel compensation circuit of FIG. 3.

FIG. 4 is a timing diagram of the OLED pixel compensation circuit of the first embodiment. The driving method of the OLED pixel compensation circuit of the first embodiment includes the following steps.

Figure 5:
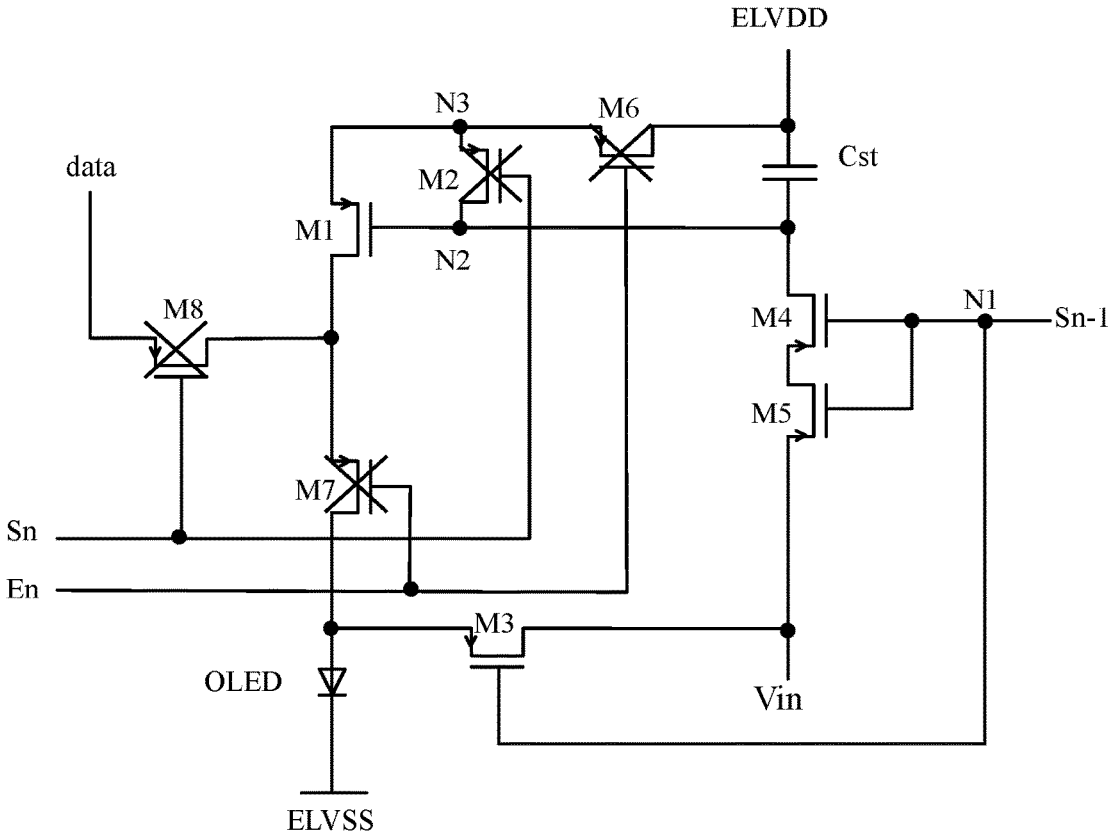
FIG. 5 shows the OLED pixel compensation circuit in a first stage.

The first stage: As shown in FIG. 4, a high level is inputted to the first scan signal line Sn and the control signal line En, and a low level is inputted to the second scan signal line Sn−1. At this time, the second transistor M2 and the eighth transistor M8 are in an off state under control of the first scan signal line Sn. The sixth transistor M6 and the seventh transistor M7 are also in an off state under control of the control signal line En. The third transistor M3, the fourth transistor M4, and the fifth transistor M5 are in an on state under control of the second scan signal line Sn−1. The circuit in the first state is shown in FIG. 5.

The voltage $V_{Vin}$ of the second power Vin is inputted through the third transistor M3 to the anode of the OLED to precharge the OLED. The voltage of the second power Vin is inputted through the fourth transistor M4 and the fifth transistor M5 to the gate of the driving transistor M1 to reset the gate of the driving transistor M1. At this time, the gate voltage of the driving transistor M1 is the voltage $V_{vin}$ of the second power Vin.

Figure 6:
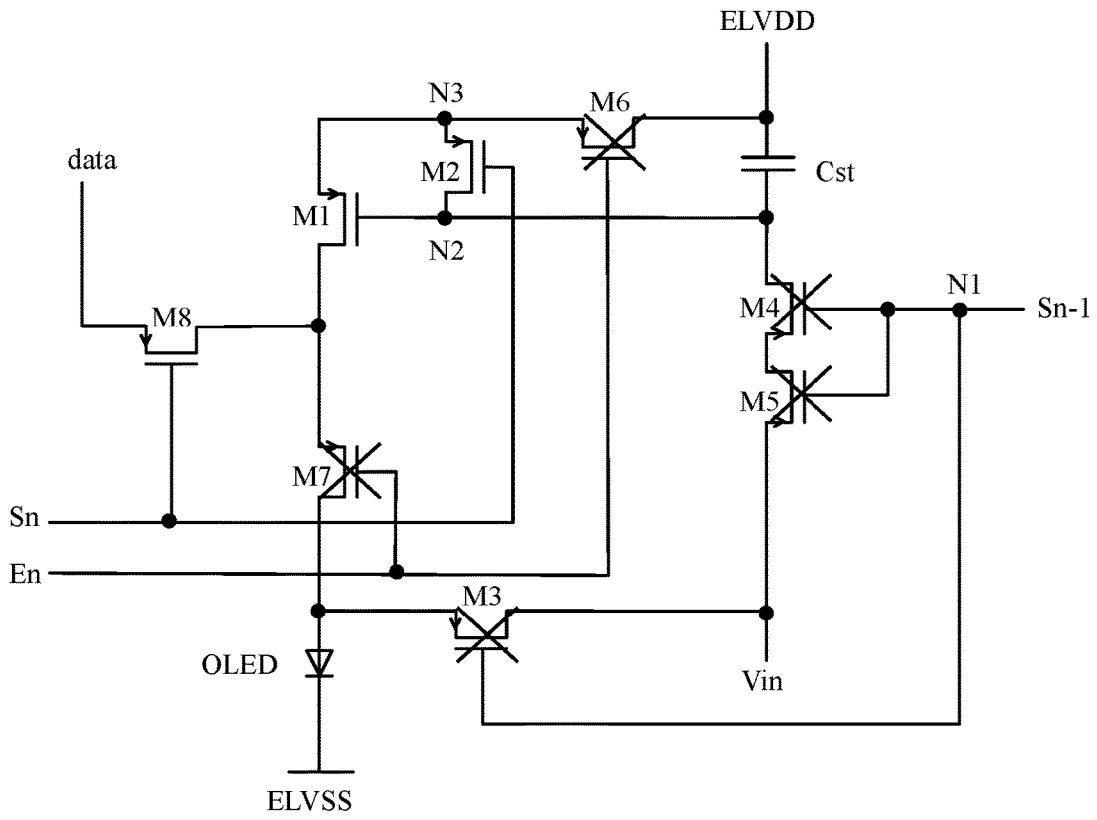
FIG. 6 shows the OLED pixel compensation circuit in a second stage.

The second stage: As shown in FIG. 4, a high level is inputted to the second scan signal line Sn−1 and the control signal line En, and a low level is inputted to the first scan signal line Sn. At this time, the third transistor M3, the fourth transistor M4, and the fifth transistor M5 are in an off state under control of the second scan signal line Sn−1. The sixth transistor M6 and the seventh transistor M7 are also in an off state under control of the control signal line En. The second transistor M2 and the eighth transistor M8 are in an on state under control of the first scan signal line Sn. The circuit in the second state is shown in FIG. 6.

The data signal $V_{data}$ of the data signal line data is inputted through the eighth transistor M8 to the second electrode of the driving transistor M1. Since the data signal $V_{data}$ of the data signal line data is larger than the voltage $V_{Vin}$ of the second power Vin (namely, the voltage of the second electrode of the driving transistor M1 is larger than the gate voltage of the driving transistor M1), the driving transistor M1 is in an on state. Thus, the data signal $V_{data}$ of the data signal line data is inputted through the driving transistor M1 and the second transistor M2 to the gate of the driving transistor M1 to charge the storage capacitor Cst. When the storage capacitor Cst is charged to an extent equal to the voltage difference ($V_{data}-V_{th}$) between the data signal $V_{data}$ of the data signal line data and the threshold voltage $V_{th}$ of the driving transistor M1, the driving transistor M1 is turned off. At this time, the gate voltage of the driving transistor M1 is the voltage difference ($V_{data}-V_{th}$) between the data signal $V_{data}$ of the data signal line data and the threshold voltage $V_{th}$ of the driving transistor M1.

Figure 7:
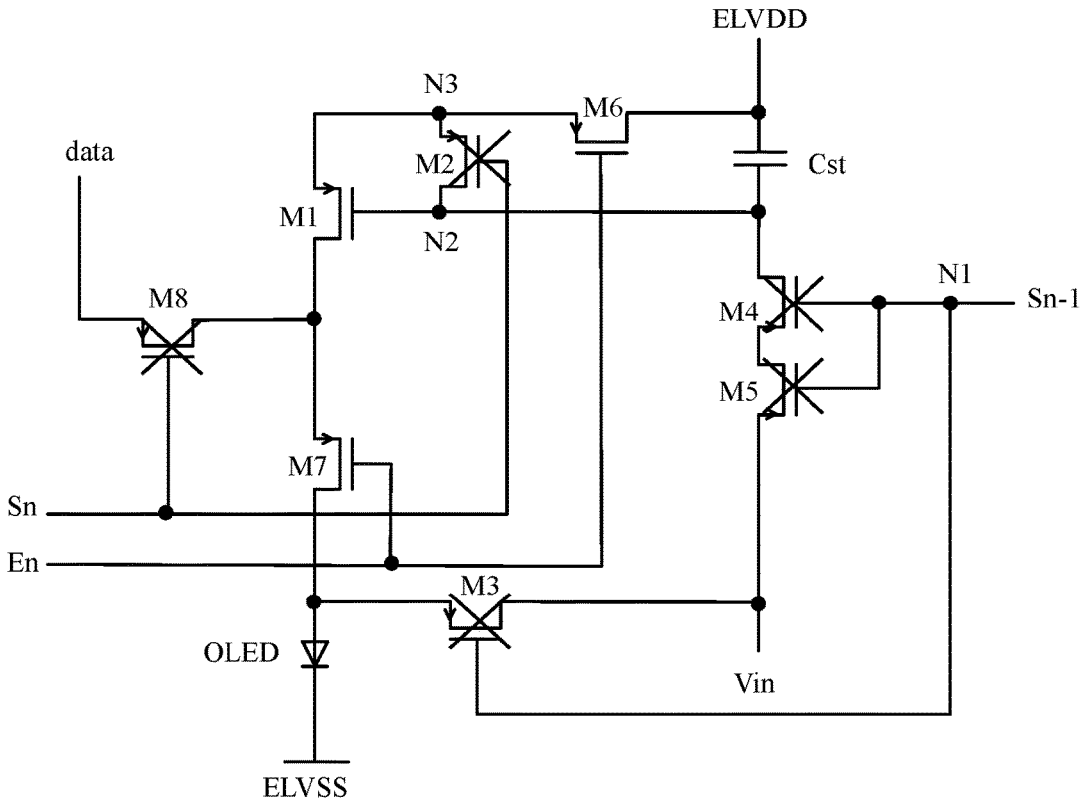
FIG. 7 shows the OLED pixel compensation circuit in a third stage.

The third stage: As shown in FIG. 4, a high level is inputted to the first scan signal line Sn and the second scan signal line Sn−1, and a low level is inputted to the control signal line En. At this time, the second transistor M2 and the eighth transistor M8 are in an off state under control of the first scan signal line Sn. The third transistor M3, the fourth transistor M4, and the fifth transistor M5 are also in an off state under control of the second scan signal line Sn−1. The sixth transistor M6 and the seventh transistor M7 are in an on state under control of the control signal line En. The circuit in the third state is shown in FIG. 7.

The voltage of the first power ELVDD is inputted through the sixth transistor M6 to the first electrode of the driving transistor M1. Since the voltage $V_{ELVDD}$ of the first power ELVDD is larger than the voltage difference ($V_{data}-V_{th}$) between the data signal $V_{data}$ of the data signal line data and the threshold voltage $V_{th}$ of the driving transistor M1 (namely, the voltage of the first electrode of the driving transistor M1 is larger than the gate voltage of the driving transistor M1), the driving transistor M1 is in the on state again. Thus, the driving transistor M1 receives the voltage $V_{ELVDD}$ of the first power ELVDD through the sixth transistor M6 to obtain the driving voltage for driving the OLED to emit light. Then, the driving voltage is inputted through the seventh transistor M7 to the OLED to thereby drive the OLED to emit light. During this procedure, a current $I_d$ continuously flows through the OLED, the current $I_d$ fulfills the following equation:

$$I_d=\tfrac{1}{2}\mu Cox\ W/L(V_{gs}-V_{th})^2=\tfrac{1}{2}\mu Cox\ W/L(V_{ELVDD}-V_{data})^2$$

During the third stage, the second transistor M2, the fourth transistor M4, and the fifth transistor M5 are in an off state, such that electrical leakage occurs. Since the voltage of node N2 is the voltage difference ($V_{data}-V_{th}$) between the data signal $V_{data}$ of the data signal line data and the threshold voltage $V_{th}$ of the driving transistor M1 and is larger than the voltage $V_{Vin}$ of the second power Vin, the voltage of the node N2 will be reduced due to electrical leakage of the fourth transistor M4 and the fifth transistor M5, resulting in an unstable gate voltage of the driving transistor M1.

At this time, since the voltage of node N3 is the voltage $V_{ELVDD}$ of the first power ELVDD and is larger than the voltage difference ($V_{data}-V_{th}$) between the data signal $V_{data}$ of the data signal line data and the threshold voltage $V_{th}$ of the driving transistor M1, the voltage of the node N2 is compensated by the electrical leakage of the second transistor M2. Thus, the second driving transistor M2 provides a balancing effect, assuring stability of the gate voltage of the driving voltage M1.

Second Embodiment

Figure 8:
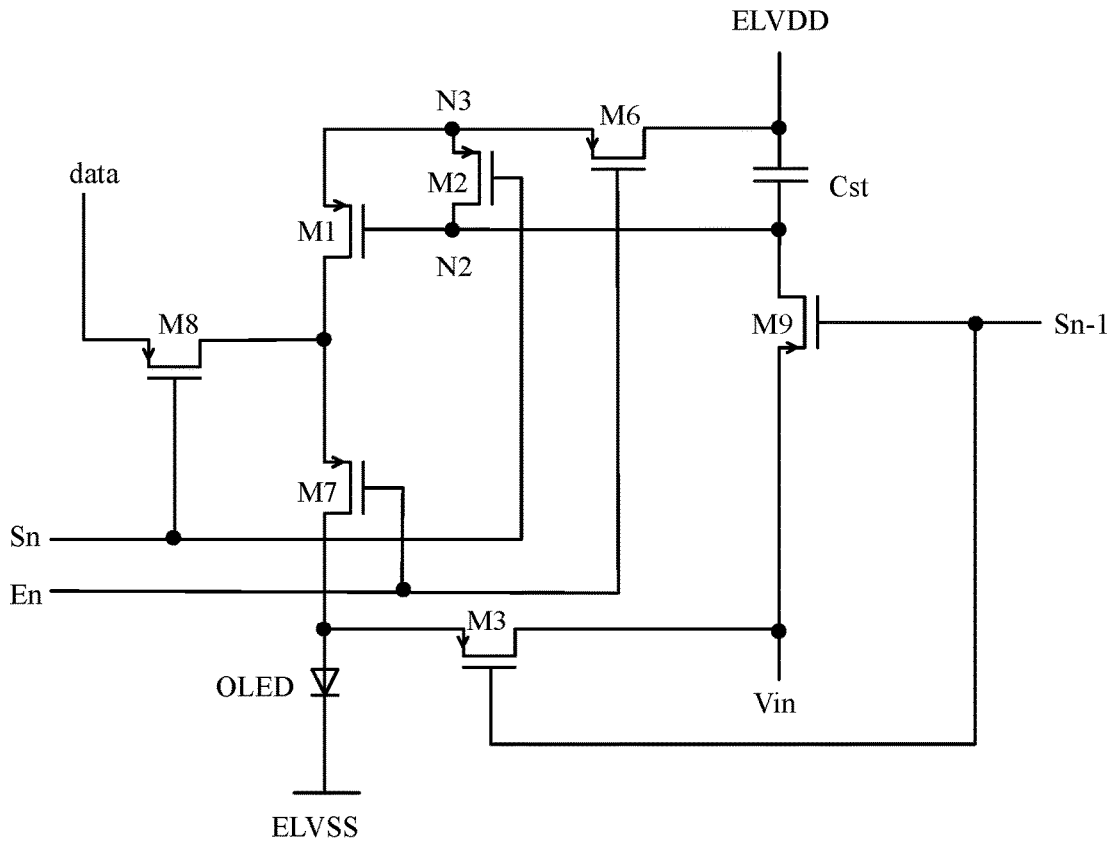
FIG. 8 shows a first example of a diagrammatic circuit diagram of an OLED pixel compensation circuit of a second embodiment according to the present invention.
Figure 9:
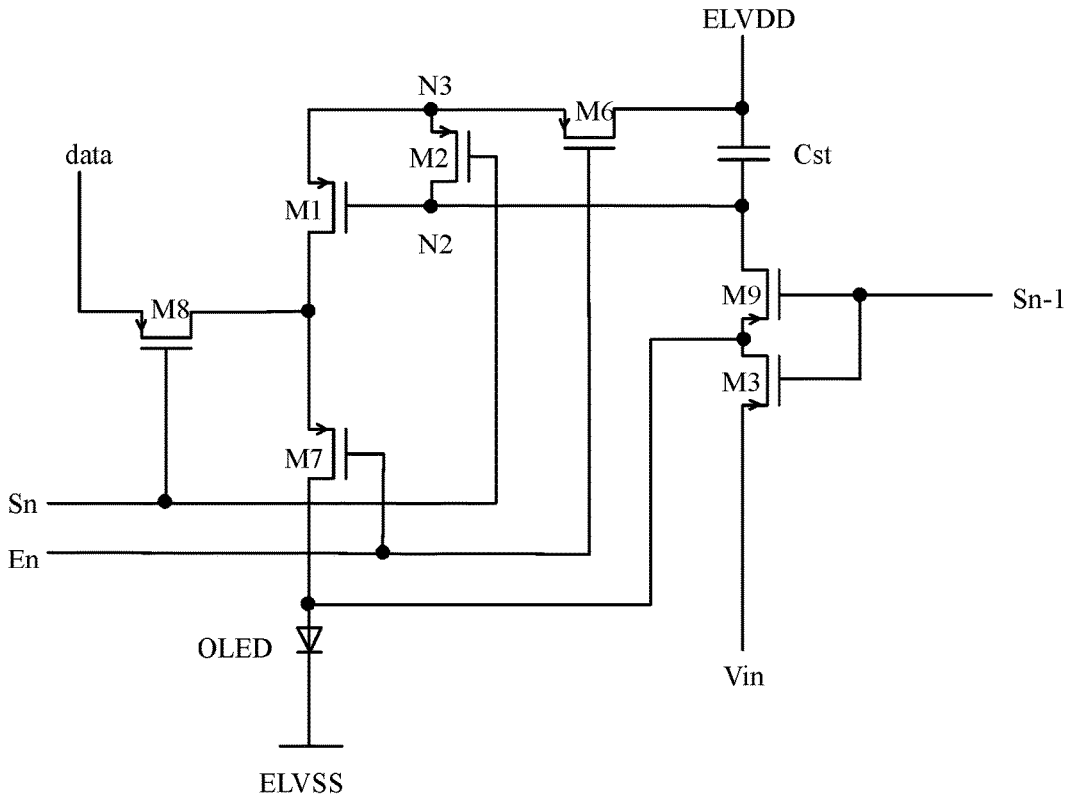
FIG. 9 shows a second example of the diagrammatic circuit diagram of the OLED pixel compensation circuit of the second embodiment according to the present invention.

FIGS. 8 and 9 show two examples of the circuit diagram of the OLED pixel compensation circuit of a second embodiment according to the present invention.

Specifically, the driving module 10 includes a driving transistor M1. The driving transistor M1 includes a first electrode connected to the second terminal of the first switch module 60. The driving transistor M1 further includes a second electrode connected to the first terminal of the second switch module 70. The driving transistor M1 further includes a gate connected to the second terminal of the compensation module 20, the first terminal of the initialization module 50, and the second terminal of the voltage storage module 90. The first electrode of the driving transistor M1 serves as the first terminal of the driving module 10. The second electrode of the driving transistor M1 serves as the second terminal of the driving module 10. The gate of the driving transistor M1 serves as the control terminal of the driving module 10.

The compensation module 20 includes a second transistor M2. The second transistor M2 includes a first electrode connected to the second terminal of the first switch module 60. The second transistor M2 further includes a second electrode connected to the gate of the driving transistor M1. The second transistor M2 further includes a gate connected to the first scan signal line Sn. The first electrode of the second transistor M2 serves as the first terminal of the compensation module 20. The second electrode of the second transistor M2 serves as the second terminal of the compensation module 20. The gate of the second transistor M2 serves as the control terminal of the compensation module 20.

The precharging module 40 includes a third transistor M3. The third transistor M3 includes a first electrode connected to the second power Vin. The third transistor M3 further includes a second electrode connected to the anode of the OLED lighting module 30. The third transistor M3 further includes a gate connected to the second scan signal line Sn−1. The first electrode of the third transistor M3 serves as the first terminal of the precharging module 40. The second electrode of the third transistor M3 serves as the second terminal of the precharging module 40. The gate of the third transistor M3 serves as the control terminal of the precharging module 40.

The initialization module 50 includes a ninth transistor M9. The ninth transistor M9 includes a first electrode connected to the gate of the driving transistor M1. The ninth transistor M9 further includes a second electrode connected to the second power Vin. The ninth transistor M9 further includes a gate connected to the second scan signal line Sn−1. The first electrode of the ninth transistor M9 serves as the first terminal of the initialization module 50. The second electrode of the ninth transistor M9 servers as the second terminal of the initialization module 50. The gate of the ninth transistor M9 serves as the control terminal of the initialization module 50.

The first switch module 60 includes a sixth transistor M6. The sixth transistor M6 includes a first electrode connected to the first power ELVDD. The sixth transistor M6 further includes a second electrode connected to the first electrode of the driving transistor M1 and the first electrode of the second transistor M2. The sixth transistor M6 further includes a gate connected to the control signal line En. The first electrode of the sixth transistor M6 serves as the first terminal of the first switch module 60. The second electrode of the sixth transistor M6 serves as the second terminal of the first switch module 60. The gate of the sixth transistor M6 serves as the control terminal of the first switch module 60.

The second switch module 70 includes a seventh transistor M7. The seventh transistor M7 includes a first electrode connected to the second electrode of the driving transistor M1. The seventh transistor M7 further includes a second electrode connected to the anode of the OLED lighting module 30. The seventh gate M7 further includes a gate connected to the control signal line En. The first electrode of the seventh gate M7 serves as the first terminal of the second switch module 70. The second electrode of the seventh transistor M7 serves as the second terminal of the second switch module 70. The gate of the seventh transistor M7 serves as the control terminal of the second switch module 70.

The data selection module 80 includes an eighth transistor M8. The eighth transistor M8 includes a first electrode connected to the second electrode of the driving transistor M1. The eighth transistor M8 further includes a second electrode connected to the data signal line data. The eighth transistor M8 further includes a gate connected to the first scan signal line Sn. The first electrode of the eighth transistor M8 serves as the first terminal of the data selection module 80. The second electrode of the eighth transistor M8 serves as the second terminal of the data selection module 80. The gate of the eighth transistor M8 serves as the control terminal of the data selection module 80.

The voltage storage module 90 is a storage capacitor Cst. The storage capacitor Cst includes a first terminal connected to the first power ELVDD and a second terminal connected to the gate of the driving transistor M1.

The anode of the OLED lighting module 30 (i.e., the OLED) is connected to the second electrode of the third transistor M3 and the second electrode of the seventh transistor M7. The cathode of the OLED lighting module 30 receives the voltage of the third power ELVSS.

Furthermore, each of the driving transistor M1, the second transistor M2, the third transistor M3, the sixth transistor M6, the seventh transistor M7, the eighth transistor M8, and the ninth transistor M9 is a p-channel thin film transistor. Each of the first power ELVDD, the second power Vin, and the data signal line data is a direct current power. The data signal $V_{data}$ of the data signal line data is larger than the voltage $V_{Vin}$ of the second power Vin. When in the lighting state, the voltage $V_{ELVDD}$ of the first power ELVDD is larger than the voltage difference ($V_{data}-V_{th}$) between the data signal $V_{data}$ of the data signal line data and the threshold voltage $V_{th}$ of the driving transistor M1. When in a black screen state, the voltage $V_{ELVDD}$ of the first power ELVDD is smaller than the voltage difference ($V_{data}-V_{th}$) between the data signal $V_{data}$ of the data signal line data and the threshold voltage $V_{th}$ of the driving transistor M1.

Figure 10:
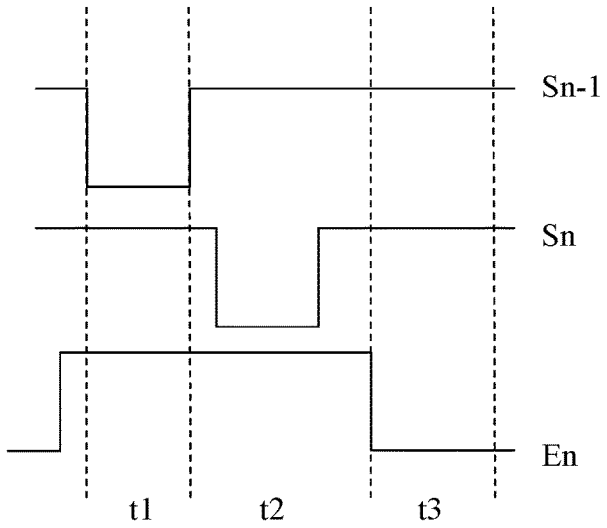
FIG. 10 is a timing diagram of the OLED pixel compensation circuit of FIG. 8.

FIG. 10 is a timing diagram of the OLED pixel compensation circuit of the second embodiment. The driving method of the OLED pixel compensation circuit of the second embodiment includes the following steps.

Figure 11:
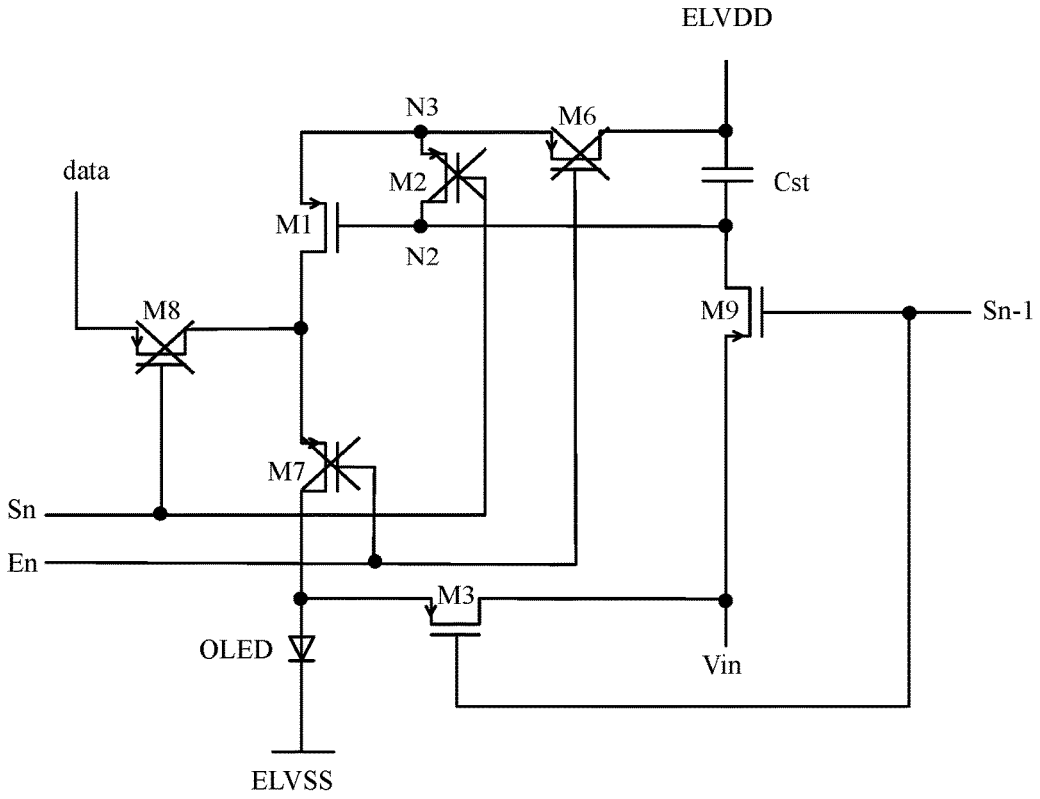
FIG. 11 shows the OLED pixel compensation circuit of FIG. 8 in a first stage.

The first stage: As shown in FIG. 10, a high level is inputted to the first scan signal line Sn and the control signal line En, and a low level is inputted to the second scan signal line Sn−1. At this time, the second transistor M2 and the eighth transistor M8 are in an off state under control of the first scan signal line Sn. The sixth transistor M6 and the seventh transistor M7 are also in an off state under control of the control signal line En. The third transistor M3 and the ninth transistor M9 are in an on state under control of the second scan signal line Sn−1. The circuit in the first state is shown in FIG. 11.

The voltage $V_{Vin}$ of the second power Vin is inputted through the third transistor M3 to the anode of the OLED to precharge the OLED. The voltage $V_{Vin}$ of the second power Vin is inputted through the ninth transistor M9 to the gate of the driving transistor M1 to reset the gate of the driving transistor M1. At this time the gate voltage of the driving transistor M1 is the voltage $V_{Vin}$ of the second power Vin.

Figure 12:
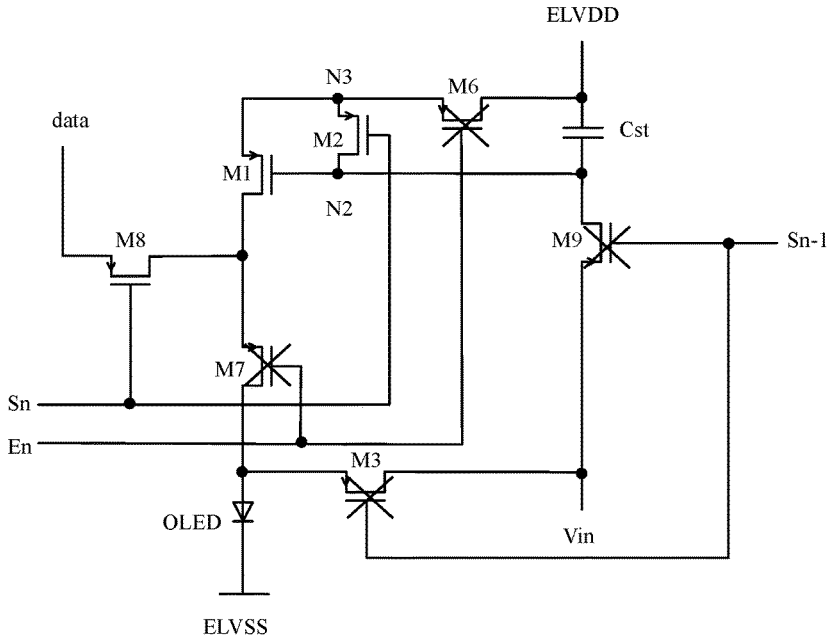
FIG. 12 shows the OLED pixel compensation circuit of FIG. 8 in a second stage.

The second stage: As shown in FIG. 10, a high level is inputted to the second scan signal line Sn−1 and the control signal line En, and a low level is inputted to the first scan signal line Sn. At this time, the third transistor M3 and the ninth transistor M9 are in an off state under control of the second scan signal line Sn−1. The sixth transistor M6 and the seventh transistor M7 are also in an off state under control of the control signal line En. The second transistor M2 and the eighth transistor M8 are in an on state under control of the first scan signal line Sn. The circuit in the second state is shown in FIG. 12.

The data signal $V_{data}$ of the data signal line data is inputted through the eighth transistor M8 to the second electrode of the driving transistor M1. Since the data signal $V_{data}$ of the data signal line data is larger than the voltage $V_{Vin}$ of the second power Vin (namely, the voltage of the second electrode of the driving transistor M1 is larger than the gate voltage of the driving transistor M1), the driving transistor M1 is in an on state. Thus, the data signal $V_{data}$ of the data signal line data is inputted through the driving transistor M1 and the second transistor M2 to the gate of the driving transistor M1 to charge the storage capacitor Cst. When the storage capacitor Cst is charged to an extent equal to the voltage difference ($V_{data}-V_{th}$) between the data signal $V_{data}$ of the data signal line data and the threshold voltage $V_{th}$ of the driving transistor M1, the driving transistor M1 is turned off. At this time, the gate voltage of the driving transistor M1 is the voltage difference ($V_{data}-V_{th}$) between the data signal $V_{data}$ of the data signal line data and the threshold voltage $V_{th}$ of the driving transistor M1.

Figure 13:
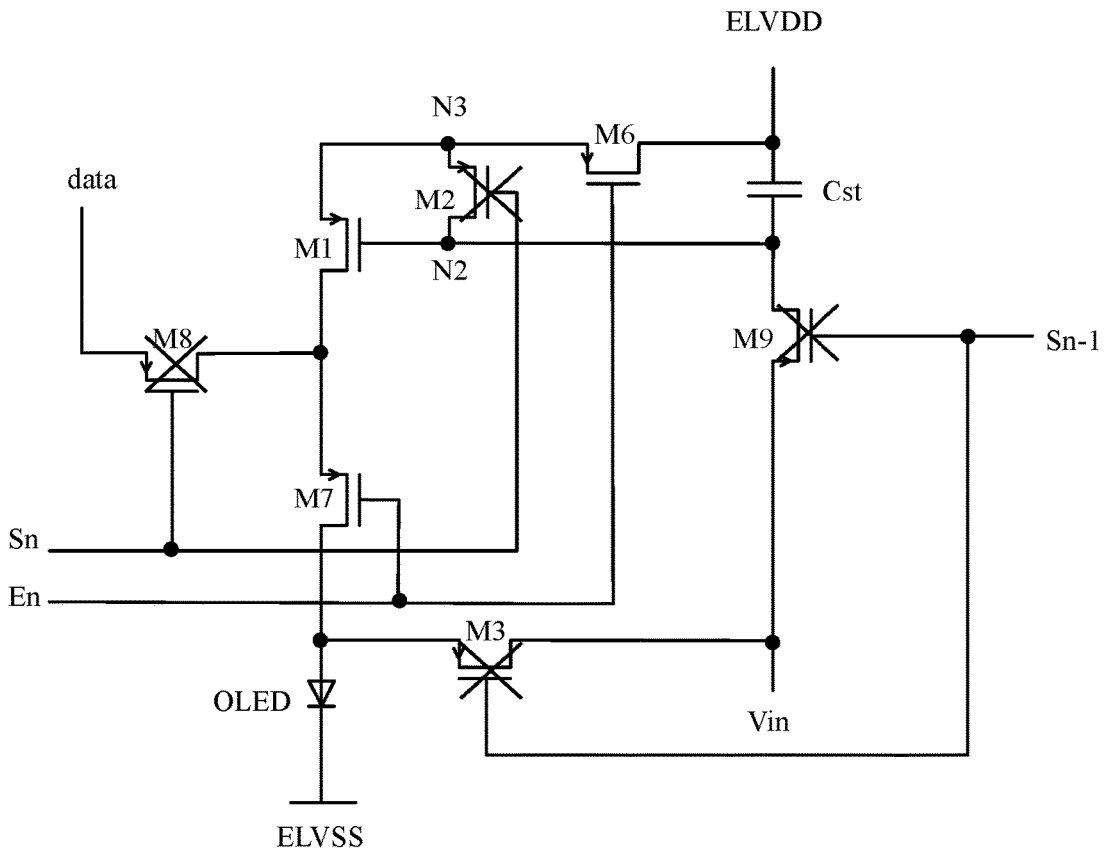
FIG. 13 shows the OLED pixel compensation circuit of FIG. 8 in a third stage.

The third stage: As shown in FIG. 10, a high level is inputted to the first scan signal line Sn and the second scan signal line Sn−1, and a low level is inputted to the control signal line En. At this time, the second transistor M2 and the eighth transistor M8 are in an off state under control of the first scan signal line Sn. The third transistor M3 and the ninth transistor M9 are also in an off state under control of the second scan signal line Sn−1. The sixth transistor M6 and the seventh transistor M7 are in an on state under control of the control signal line En. The circuit in the third state is shown in FIG. 13.

The voltage of the first power ELVDD is inputted through the sixth transistor M6 to the first electrode of the driving transistor M1. Since the voltage $V_{ELVDD}$ of the first power ELVDD is larger than the voltage difference ($V_{data}-V_{th}$) between the data signal $V_{data}$ of the data signal line data and the threshold voltage $V_{th}$ of the driving transistor M1 (namely, the voltage of the first electrode of the driving transistor M1 is larger than the gate voltage of the driving transistor M1), the driving transistor M1 is in the on state again. Thus, the driving transistor M1 receives the voltage $V_{ELVDD}$ of the first power ELVDD through the sixth transistor M6 to obtain the driving voltage for driving the OLED to emit light. Then, the driving voltage is inputted through the seventh transistor M7 to the OLED to thereby drive the OLED to emit light. During this procedure, a current $I_d$ continuously flows through the OLED, the current $I_d$ fulfills the following equation:

$$I_d=\tfrac{1}{2}\mu Cox\ W/L(V_{gs}-V_{th})^2=\tfrac{1}{2}\mu Cox\ W/L(V_{ELVDD}-V_{data})^2$$

During the third stage, the second transistor M2 and the ninth transistor M9 are in an off state, such that electrical leakage occurs. Since the voltage of node N2 is the voltage difference ($V_{data}-V_{th}$) between the data signal $V_{data}$ of the data signal line data and the threshold voltage $V_{th}$ of the driving transistor M1 and is larger than the voltage $V_{Vin}$ of the second power Vin, the voltage of the node N2 will be reduced due to electrical leakage of the ninth transistor M9, resulting in an unstable gate voltage of the driving transistor M1.

At this time, since the voltage of node N3 is the voltage $V_{ELVDD}$ of the first power ELVDD and is larger than the voltage difference ($V_{data}-V_{th}$) between the data signal $V_{data}$ of the data signal line data and the threshold voltage $V_{th}$ of the driving transistor M1, the voltage of the node N2 is compensated by the electrical leakage of the second transistor M2. Thus, the second driving transistor M2 provides a balancing effect, assuring stability of the gate voltage of the driving voltage M1.

Figure 1:
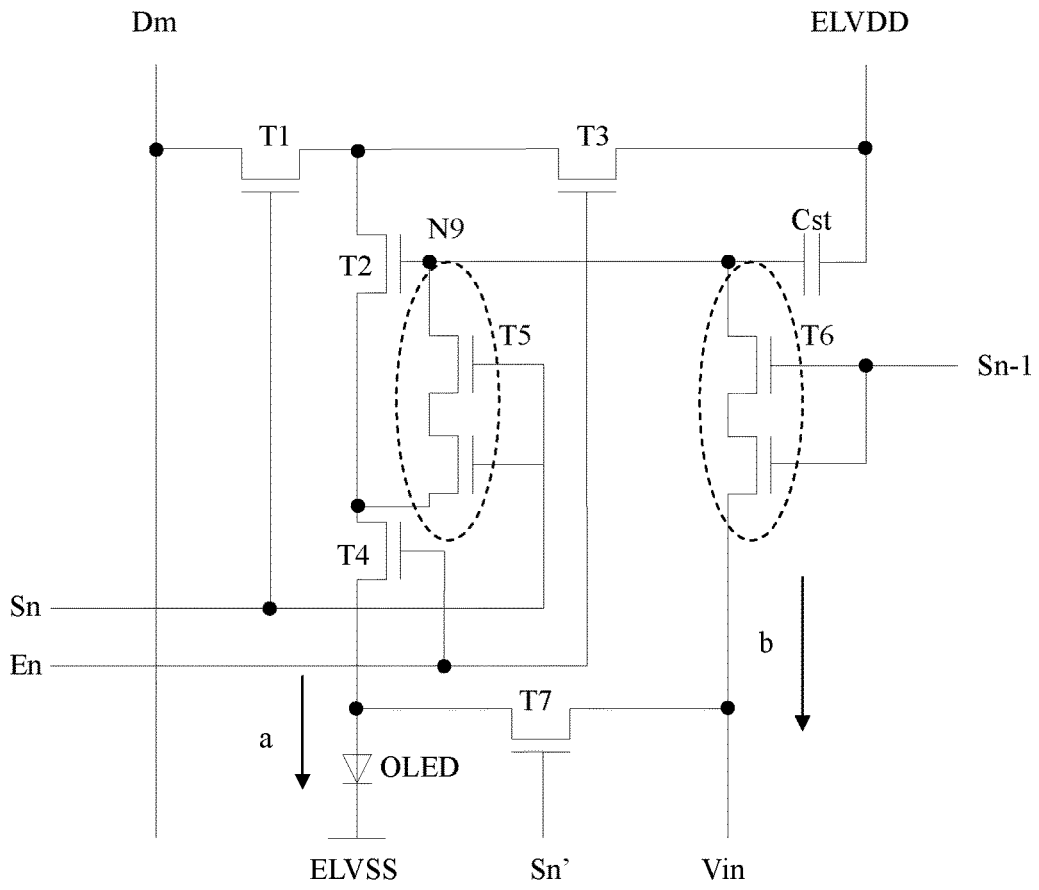
FIG. 1 (prior art)
FIG. 1 is a diagrammatic circuit diagram of a conventional OLED pixel compensation circuit.
Figure 14:
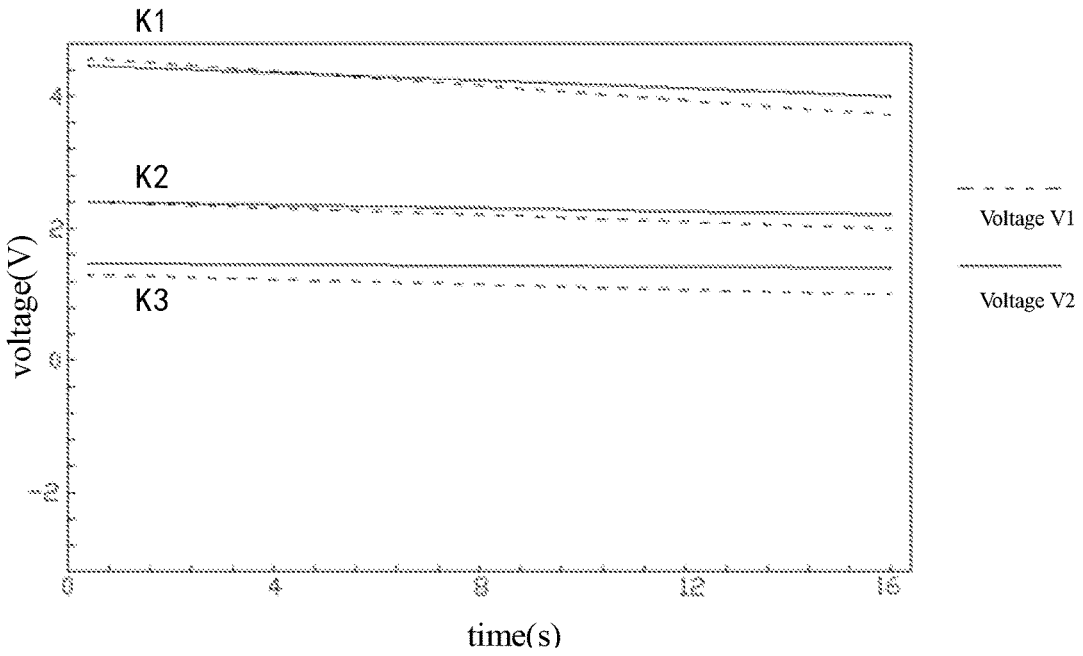
FIG. 14 is a diagram illustrating differences of the leak voltage of driving transistor of the OLED pixel compensation circuit according to the present invention and the driving transistor of the conventional OLED pixel compensation circuit.

FIG. 14 is a diagram illustrating differences of the leak voltage of the driving transistor M1 of the OLED pixel compensation circuit (FIG. 3) according to the present invention and the driving transistor T2 of the conventional OLED pixel compensation circuit (FIG. 1). Voltage V1 is the gate voltage of the driving transistor T2 of the conventional OLED pixel compensation circuit. Voltage V2 is the gate voltage of the driving transistor M1 of the OLED pixel compensation circuit according to the present invention.

It is assumed that the value of the storage capacitor Cst of the conventional OLED pixel compensation circuit is 0.23 pF and it is assumed that the value of the storage capacitor Cst of the OLED pixel compensation circuit according to the present invention is 0.18 pF. Given the above capacitor conditions, curves K1 show the change of the gate voltages of the driving transistors M1 and T2 when the OLEDs are in the black state, curves K2 show the change of the gate voltages of the driving transistors M1 and T2 when the OLEDs are in the grey state, and curves K3 show the change of the gate voltages of the driving transistors M1 and T2 when the OLEDs are in the white state.

As can be seen from Table 1 below, given the storage capacitor Cst of the OLED pixel compensation circuit according to the present invention is smaller than the storage capacitor Cst of the conventional OLED pixel compensation circuit, the leak voltage difference of the gate voltage of the driving transistor M1 in the grey state is smaller than the leak voltage difference of the gate voltage of the driving transistor T2 of the conventional OLED pixel compensation circuit in the grey state. Thus, compared to the conventional OLED pixel compensation circuit, the OLED pixel compensation circuit according to the present invention assures the stability of the gate voltage of the driving transistor M1.

TABLE 1

| | Leak voltage difference in white screen state | Leak voltage difference in grey screen state | Leak voltage difference in black screen state |
|---|---|---|---|
| Cst = 0.23 pF | 1.27 − 1.16 = 0.11 V | 2.31 − 2.01 = 0.3 V | 4.58 − 3.75 = 0.83 V |
| Cst = 0.18 pF | 1.31 − 1.30 = 0.01 V | 2.28 − 2.17 = 0.11 V | 4.47 − 4.05 = 0.42 V |

In view of the foregoing, the OLED pixel compensation circuit according to the present invention not only pre-charges the OLED by the third transistor M3 to prolong the service life of the OLED display device but compensates the gate voltage of the driving transistor M1 by the second transistor M2 to reduce the influence on the gate voltage of the driving transistor M1 by the transistors in the off state in the circuit due to leak current, thereby reducing the influence on the image display quality by the transistors due to electrical leakage. Furthermore, the stability of the gate voltage of the driving transistor M1 is assured while reducing the value of the storage capacitor Cst. Thus, the space occupied by the storage capacitor Cst is reduced to increase the output space, such that the pixels per inch (PPI) of the OLED display device are increased.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. An organic light-emitting diode pixel compensation circuit comprising a driving module, a compensation module, an organic light-emitting diode (OLED) module, an initialization module, a data selection module, and a precharging module, wherein the improvements comprise:

the compensation module is connected to the driving module and is configured to receive a voltage supplied from an external first power to compensate a turn-on voltage of the driving module, the precharging module is connected to the OLED module and is configured to receive a voltage supplied from an external second power to precharge the OLED module, and the driving module is connected to the OLED module and is configured to remain ON state by compensation effection of the compensation module, such that the voltage supplied from the external first power is able to be received by the driving module and transferred to drive the OLED module, each of the driving module, the compensation module, and the precharging module includes a first terminal, a second terminal, and a control terminal, the first terminal of the driving module is connected to the first power, the second terminal of the driving module is connected to an anode of the OLED module, the control terminal of the driving module is connected to the second terminal of the compensation module, the first terminal of the compensation module is connected to the first power, the control terminal of the compensation module is connected to and controlled by an external first scan signal line, the first terminal of the precharging module is connected to the second power Vin, the second terminal of the precharging module is connected to the anode of the OLED module, the control terminal of the precharging module is connected to and controlled by an external second scan line, and the OLED module includes a cathode configured to receive a voltage supplied from a third power, the initialization module comprises a first terminal connected to the control terminal of the driving module, a second terminal connected to the second power source and configured to receive the voltage of the second power and to clear the voltage currently stored by the control terminal of the driving module, and a control terminal connected to and controlled by the second scan line, the data selection module comprises a first terminal connected to the second terminal of the driving module, a second terminal connected to an external data signal line and configured to receive a data signal of the data signal line and to input the data signal to the control terminal of the driving module, and a control terminal connected to and controlled by the first scan line.

2. The organic light-emitting diode pixel compensation circuit of claim 1, wherein the external second scan line is an N−1th scan signal line, and the external first scan line is an Nth scan signal line.

3. The organic light-emitting diode pixel compensation circuit of claim 1, further comprising a voltage storage module, wherein the voltage storage module comprises a first terminal and a second terminal, the first terminal of the voltage storage module is connected to the first power, and the second terminal of the voltage storage module is connected to the control terminal of the driving module and configured to store the voltage received by the control terminal of the driving module.

4. The organic light-emitting diode pixel compensation circuit of claim 3, further comprising a first switch module, wherein the first switch module including a first terminal connected to the first power, a second terminal connected to the first terminal of the driving module and the first terminal of the compensation module and configured to control ON and OFF states states of circuits individually between the first power and the driving module and between the first power and the compensation module, and a control terminal connected to and controlled by an external control signal lineON and OFF statesON and OFF states.

5. The organic light-emitting diode pixel compensation circuit of claim 4, further comprising a second switch module, wherein the second switch module comprises a first terminal connected to the second terminal of the driving module, a second terminal connected to the anode of the OLED module and configured to control ON and OFF states states of a circuit between the driving module and the OLED module, and a control terminal connected to and controlled by the control signal lineON and OFF states.

6. The organic light-emitting diode pixel compensation circuit of claim 5, wherein the driving module comprises a driving transistor, the driving transistor includes a first electrode serving as the first terminal of the driving module, with the driving transistor further including a second electrode serving as the second terminal of the driving module, and with the driving transistor further including a gate serving as the control terminal of the driving module.

7. The organic light-emitting diode pixel compensation circuit of claim 6, with the compensation module including a second transistor, with the second transistor including a first electrode serving as the first terminal of the compensation module, with the second transistor further including a second electrode serving as the second terminal of the compensation module, and with the second transistor further including a gate serving as the control terminal of the compensation module.

8. The organic light-emitting diode pixel compensation circuit of claim 7, with the precharging module including a third transistor, with the third transistor including a first electrode serving as the first terminal of the precharging module, with the third transistor further including a second electrode serving as the second terminal of the precharging module, and with the third transistor further including a gate serving as the control terminal of the precharging module.

9. The organic light-emitting diode pixel compensation circuit of claim 8, with the first switch module including a sixth transistor, with the sixth transistor including a first electrode serving as the first terminal of the first switch module, with the sixth transistor further including a second electrode serving as the second terminal of the first switch module, and with the sixth transistor further including a gate serving as the control terminal of the first switch module.

10. The organic light-emitting diode pixel compensation circuit of claim 9, with the second switch module including a seventh transistor, with the seventh transistor including a first electrode serving as the first terminal of the second switch module, with the seventh transistor further including a second electrode serving as the second terminal of the second switch module, and with the seventh transistor further including a gate serving as the control terminal of the second switch module.

11. The organic light-emitting diode pixel compensation circuit of claim 10, with the data selection module including an eighth transistor, with the eighth transistor including a first electrode serving as the first terminal of the data selection module, with the eighth transistor further including a second electrode serving as the second terminal of the data selection module, and with the eighth transistor further including a gate serving as the control terminal of the data selection module.

12. The organic light-emitting diode pixel compensation circuit of claim 11, with the voltage storage module being a storage capacitor, with the storage capacitor including a first terminal connected to the first power and a second terminal connected to the gate of the driving transistor.

13. The organic light-emitting diode pixel compensation circuit of claim 12, with the initialization module including a dual gate structure having a fourth transistor and a fifth transistor, with the fourth transistor including a first electrode serving as the first terminal of the initialization module, with the fourth transistor further including a second electrode connected to a first electrode of the fifth transistor, with a gate of the fourth transistor and a gate of the fifth transistor connected to a same node serving as the control terminal of the initialization module, and with the fifth transistor further including a second electrode serving as the second terminal of the initialization module.

14. The organic light-emitting diode pixel compensation circuit of claim 13, wherein each of the driving transistor, the second transistor, the third transistor, the fourth transistor, the fifth transistor, the sixth transistor, the seventh transistor, and the eighth transistor is a p-channel thin film transistor.

15. The organic light-emitting diode pixel compensation circuit of claim 12, with the initialization module including a ninth transistor, with the ninth transistor including a first electrode serving as the first terminal of the initialization module, with the ninth transistor further including a second electrode serving as the second terminal of the initialization module, and with the ninth transistor further including a gate serving as the control terminal of the initialization module.

16. The organic light-emitting diode pixel compensation circuit of claim 15, wherein each of the driving transistor, the second transistor, the third transistor, the sixth transistor, the seventh transistor, the eighth transistor, and the ninth transistor is a p-channel thin film transistor.

17. The organic light-emitting diode pixel compensation circuit of claim 13, wherein each of the first power, the second power, and the data signal line is a direct current power supplier, and the data signal provided from the data signal line is larger than the voltage provided from the second power, and the voltage provided from the first power is larger than a voltage difference between the data signal of the data signal line and a threshold voltage of the driving transistor.

* * * * *